US008523465B2

(12) United States Patent
Inoue

(10) Patent No.: US 8,523,465 B2
(45) Date of Patent: Sep. 3, 2013

(54) PRINTER WITH MULTI-CURVED INTERMEDIATE TRANSPORTATION PATH

(75) Inventor: Nobuhiro Inoue, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 664 days.

(21) Appl. No.: 12/711,508

(22) Filed: Feb. 24, 2010

(65) Prior Publication Data

US 2010/0221058 A1 Sep. 2, 2010

(30) Foreign Application Priority Data

Mar. 2, 2009 (JP) ..... 2009-047666

(51) Int. Cl.
*B41J 15/04* (2006.01)
*B41J 15/16* (2006.01)
*B41J 29/13* (2006.01)

(52) U.S. Cl.
USPC ..... 400/605; 400/618; 400/619; 400/613.2

(58) Field of Classification Search
USPC ..... 400/605, 607, 607.2, 608.2, 608.4, 400/609, 611, 618, 619, 613.2
IPC ..... B41J 11/58
See application file for complete search history.

(56) References Cited

U.S. PATENT DOCUMENTS

| | | | | | |
|---|---|---|---|---|---|
| 4,452,543 | A | * | 6/1984 | Adkisson et al. | 400/605 |
| 4,732,501 | A | * | 3/1988 | Angst et al. | 400/616.3 |
| 4,961,659 | A | * | 10/1990 | Igarashi | 400/693 |
| 5,718,526 | A | * | 2/1998 | Yokota | 400/605 |

FOREIGN PATENT DOCUMENTS

| | | | | |
|---|---|---|---|---|
| JP | 61192576 | A | * | 8/1986 |
| JP | 05-092628 | | | 4/1993 |
| JP | 05138968 | A | * | 6/1993 |
| JP | 05301403 | A | * | 11/1993 |
| JP | 08-259051 | A | | 10/1996 |
| JP | 08-300754 | | | 11/1996 |
| JP | 09-277632 | | | 10/1997 |
| JP | 2000-296952 | | | 10/2000 |
| JP | 2004277087 | A | * | 10/2004 |
| JP | 2008-001069 | | | 1/2008 |

* cited by examiner

*Primary Examiner* — Daniel J Colilla

(57) ABSTRACT

A printer enables setting fanfold paper inserted from a paper inlet to a horizontal transportation path that passes the printing position without paper jams occurring. The horizontal paper transportation path is positioned downstream of a first transportation path that extends from the paper inlet and a second transportation path that extends from a roll paper compartment, all of which are formed inside the printer. An attachment of an access cover to the roll paper compartment forms an intermediate paper path that renders the first and horizontal paper paths continuous at a junction near the convergence of the first and second paper transportation paths. The intermediate paper transportation path not only renders a continuous path for the fanfold paper from the paper inlet to the printing position, it smoothes the flow of the fanfold paper to the horizontal paper transportation path.

8 Claims, 8 Drawing Sheets

PRINTER WITH MULTI-CURVED INTERMEDIATE TRANSPORTATION PATH

CROSS-REFERENCE TO RELATED APPLICATION(S)

Japanese Patent application No. 2009-047666 is hereby incorporated by reference in its entirety.

BACKGROUND

1. Field of Invention

The present invention relates to a printer that can uniformly handle different types of continuous recording paper, such as roll paper and fanfold paper. More particularly, the invention relates to a printer having a common transportation path that passes a printing position inside the printer, a first paper transportation path from the paper inlet toward the common transportation path, and a second paper transportation path from a roll paper compartment toward the common transportation path.

2. Description of Related Art

Printers that can selectively use fanfold paper and roll paper are known from the literature. In this type of printer, fanfold paper is inserted from a paper inlet into the printer case, and then conveyed through a paper transportation path past the printing position and printed. Roll paper is held in a roll paper compartment rendered inside the case, and the recording paper pulled off the roll is conveyed from the roll paper compartment through the paper transportation path past the printing position and printed. The portion of the paper transportation path that passes the printing position is a common transportation path through which both the fanfold paper and roll paper are conveyed.

The printer taught in Japanese Unexamined Patent Appl. Pub. JP-A-2008-1069 has both a fanfold paper transportation path that goes from the paper inlet to the common transportation path, and a roll paper transportation path that goes from the roll paper compartment to the common transportation path, inside the printer.

Because the entire roll paper transportation path from the roll paper compartment to the common transportation path is rendered inside the case in the printer of JP-A-2008-1069, the printer can be made smaller. However, in order to load fanfold paper inserted from the paper inlet to the printing position, the printer cover must be opened and the fanfold paper must be manually threaded from the fanfold paper transportation path to the common transportation path in the same way as when the roll paper is loaded.

More specifically, in order to guide both roll paper pulled from the paper roll and fanfold paper to the common transportation path, the roll paper path and the fanfold paper path must merge upstream from the common transportation path. A disjunction is therefore formed where the paths merge between the common transportation path and the roll paper transportation path, and between the common transportation path and the fanfold paper transportation path. However, if a disjunction is formed between the common transportation path and the fanfold paper transportation path, fanfold paper inserted from the paper inlet to the printer can be directed at this disjunction in a direction other than the desired direction, and may thus be unable to reach the common transportation path. A seam in the fanfold paper may also get caught at this disjunction, resulting in the fanfold paper inserted to the printer becoming jammed. To avoid this problem with the printer of JP-A-2008-1069, the printer cover has to be opened in order to guide the fanfold paper to the common transportation path.

In the printer taught in JP-A-2000-296952, the paper inlet communicates directly with the common transportation path, and there is therefore no interruption in the fanfold paper transportation path from the paper inlet to the printing position. Fanfold paper can therefore be loaded into the common transportation path without opening the printer cover by simply inserting the fanfold paper from the paper inlet into the printer. However, because the roll paper transportation path from the roll paper compartment to the common transportation path detours through the paper inlet, the entire roll paper transportation path cannot be rendered inside the printer, and reducing the size of the printer is thus impeded.

SUMMARY OF INVENTION

A printer according to the present invention enables loading recording paper inserted from the paper inlet to the common transportation path without the paper becoming jammed even when the common transportation path, which passes the printing position, a first paper transportation path from the paper inlet to the common transportation path, and a second paper transportation path from the roll paper compartment to the common transportation path are rendered inside the printer.

A printer according to a first aspect of the invention has a first paper transportation path that guides a first recording paper; a second paper transportation path that guides a second recording paper; a common transportation path that passes the printing position and is common to at least a part of the first paper transportation path and to at least a part of the second paper transportation path. The printer forms an intermediate paper transportation path between the common transportation path and the first paper transportation path near a position where the first paper transportation path and the second paper transportation path merge. The intermediate paper transportation path has a multi-curved shape in the paper transportation direction.

Preferably, the first paper transportation path includes a paper inlet for inserting the first recording paper, and the second paper transportation path guides the second recording paper pulled from a roll paper compartment.

Yet further preferably, the printer also has an attachment for forming the intermediate paper transportation path, and the attachment connects the first paper transportation path with the common transportation path.

Further preferably, the printer also has an access cover for opening and closing the roll paper compartment. The attachment is attached to the access cover, and the intermediate paper transportation path opens in conjunction with the operation opening the access cover, and the intermediate paper transportation path is formed in conjunction with the operation closing the access cover.

The printer according to embodiments of the invention has an attachment for forming an intermediate paper transportation path. When the attachment is attached to the access cover and the access cover closes, for example, such an intermediate paper transportation path connecting the common transportation path and the first paper transportation path is formed near where the first paper transportation path and the second paper transportation path merge. As a result, recording paper inserted from the paper inlet can be guided to the common transportation path without jamming, and can be loaded in the common transportation path.

More specifically, the attachment of the invention serves to eliminate a disjunction that would otherwise be formed in an arrangement involving multiple transportation paths and different paper sources. When a common transportation path passing the printing position, a first paper transportation path that guides a first recording paper from the paper inlet to the common transportation path, and a second paper transportation path that guides a second recording paper from a roll paper compartment to the common transportation path are rendered inside the case, such a disjunction is formed between a common transportation path and a first paper transportation path and between the common transportation path and the second paper transportation path where the first paper transportation path and the second paper transportation path merge with the upstream end of the common transportation path. As a result, when the first recording paper is inserted to the case from the paper inlet, the first recording paper may be misdirected at this disjunction in a direction other than the desired direction, and the recording paper may catch and become jammed at this disjunction.

The attachment of the invention forms an intermediate paper transportation path connecting the common transportation path and the first paper transportation path where the paths merge, thus eliminating the disjunction. As a result, the first recording paper can be guided to the common transportation path by simply being inserted from the paper inlet, and the first recording paper can be set in the common transportation path.

Furthermore, because the attachment is attached to the access cover for opening and closing the roll paper compartment, the location where the attachment is installed can be accessed by opening the access cover.

Yet further, because the intermediate paper transportation path is formed in conjunction with closing the access cover, the common transportation path and the first paper transportation path can be connected by a simple operation. In addition, if the first recording paper becomes jammed in the intermediate paper transportation path, the paper jam of the first recording paper can be easily recovered because the intermediate paper transportation path opens in conjunction with opening the access cover.

Furthermore, when the common transportation path and the first paper transportation path are rendered continuous by the attachment at the junction between the first paper transportation path and the second paper transportation path, space between when the second paper transportation path and the common transportation path is closed. Therefore, when using the first recording paper is selected, mistakenly loading the second recording paper in the common transportation path can be prevented.

Further preferably, the second paper transportation path has a tension guide for adjusting the tension of the second recording paper pulled from the roll paper compartment, the tension guide is disposed to the access cover, and the attachment is removably attached to the tension guide.

The tension guide is used only when the second recording paper is selected as the printing medium, and is not used when the first recording paper is selected. Therefore, if the attachment is removably attached to this tension guide, a member for installing the attachment is not separately needed. Furthermore, because the location where the attachment is installed can be accessed by opening the access cover, and the attachment can be easily installed and removed, the invention is suited for selectively using a first recording paper and a second recording paper.

When the intermediate paper transportation path is configured with a curved shape in the transportation direction, the first recording paper is straightened as it passes the multi-curved (e.g., S-shaped) portion of the paper transportation path. Because the folds in the paper are thus straightened when the first recording paper is fanfold paper, fanfold paper can be prevented from lifting up and interfering with the print head as the paper passes through the common transportation path at the printing position.

In order to render the intermediate paper transportation path with a curved shape, the printer according to according to another aspect of the invention further preferably has a paper pressure roller at a position opposing the attachment, and the multi-curved shape is formed by the surface of the attachment opposing the paper pressure roller and the outside surface of the paper pressure roller.

Furthermore, so that the intermediate paper transportation path is reliably formed by the attachment, the printer preferably has a guide surface that guides an end of the attachment in the paper width direction beside the paper pressure roller when the access cover closes. When thus configured, the attachment can be prevented from colliding with the paper pressure roller when the intermediate paper transportation path is formed.

Yet further preferably, the second paper transportation path becomes open in conjunction with the operation opening the access cover, and the second paper transportation path is formed in conjunction with the operation closing the access cover.

Because the paper transportation path for conveying the second recording paper from the second paper transportation path to the common transportation path becomes open when thus configured and the access cover opens, the second recording paper can be set to the printing position by simply loading roll paper from which the second recording paper is pulled off into the roll paper compartment and then closing the access cover.

EFFECTS OF THE INVENTION

The printer according to embodiments of the invention has an attachment for forming an intermediate paper transportation path. When the attachment is attached to the access cover and the access cover closes, for example, an intermediate paper transportation path connecting the common transportation path and the first paper transportation path is formed near where the first paper transportation path and the second paper transportation path merge. As a result, recording paper inserted from the paper inlet can be guided to the common transportation path without jamming, and can be loaded in the common transportation path.

Furthermore, when the common transportation path and the first paper transportation path are rendered continuous by the attachment at the junction between the first paper transportation path and the second paper transportation path, space between when the second paper transportation path and the common transportation path is closed. Therefore, when using the first recording paper is selected, mistakenly loading the second recording paper in the common transportation path can be prevented.

Other objects and attainments together with a fuller understanding of the invention will become apparent and appreciated by referring to the following description and claims taken in conjunction with the accompanying drawings.

DESCRIPTION OF EXEMPLARY EMBODIMENTS

A printer according to a preferred embodiment of the present invention is described below with reference to the accompanying figures.

General Configuration

Figure 1:
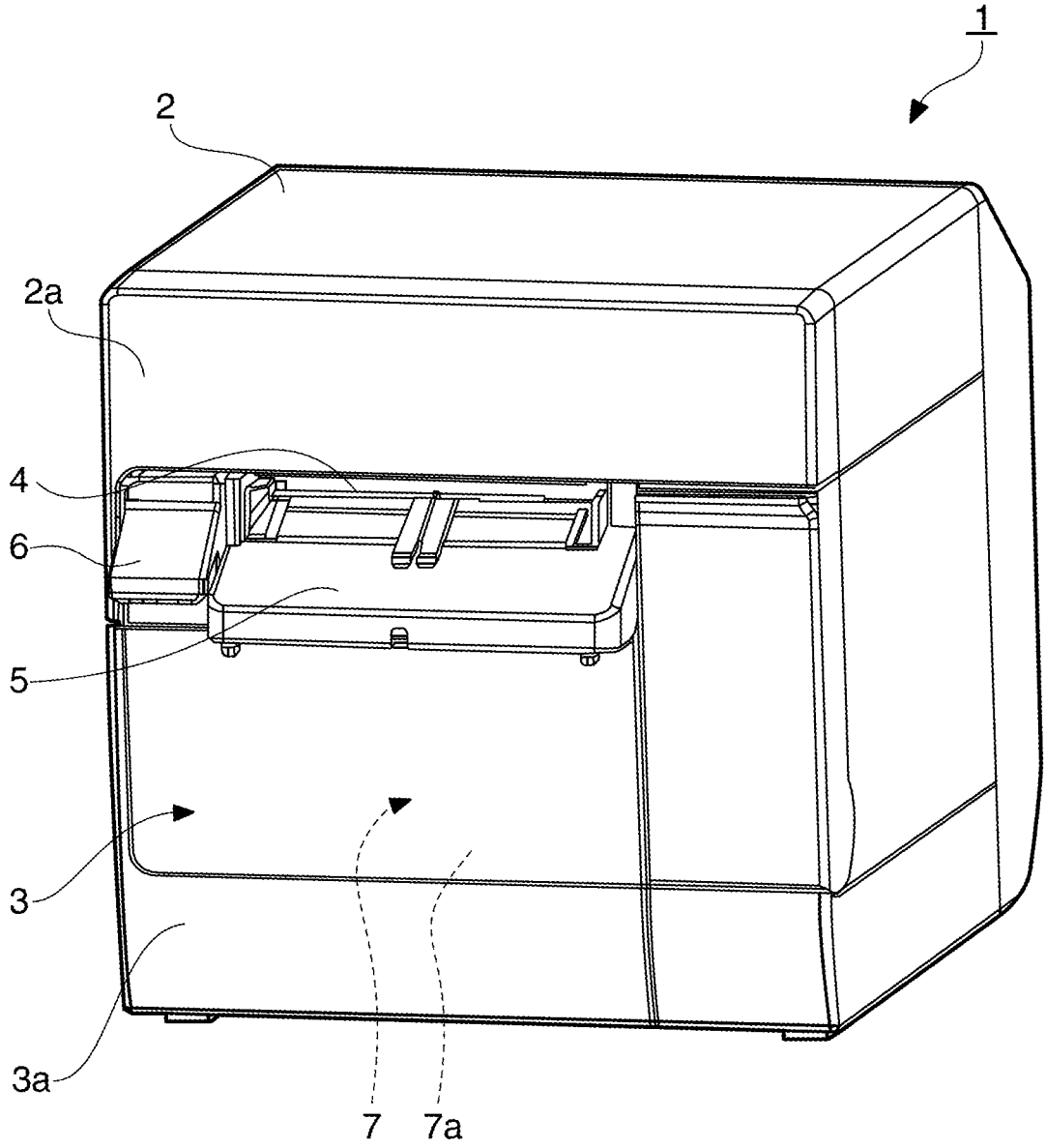
FIG. 1 is an external oblique view of a printer according to a preferred embodiment of the invention.
Figure 2:
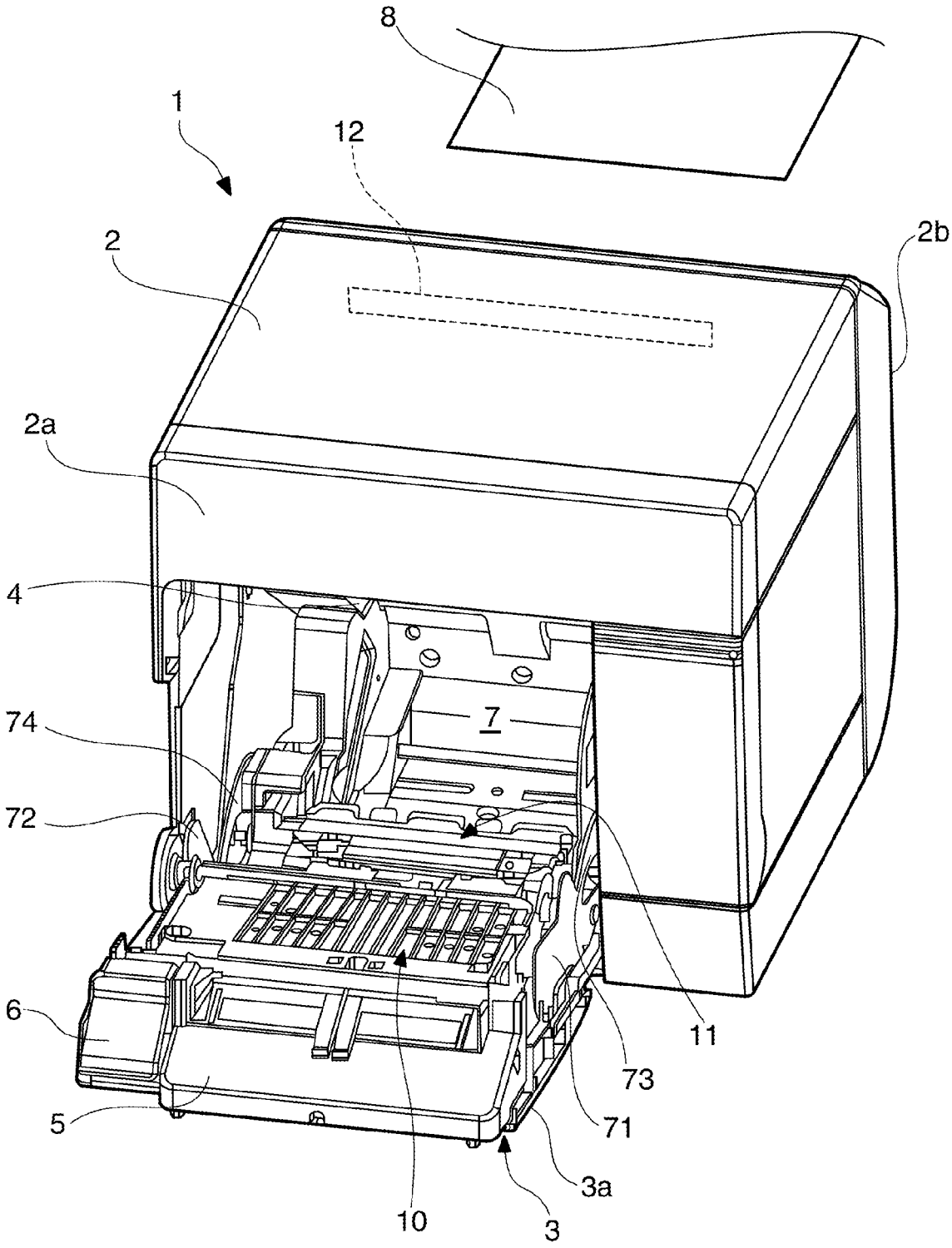
FIG. 2 is an external oblique view of the printer with the access cover open.

FIG. 1 is an external oblique view of a printer according to a first embodiment of the invention. FIG. 2 is an external oblique view of the printer with the cover completely open.

The printer 1 has a rectangular box-like body 2 and an access cover unit 3 that opens and closes and is disposed to the front of the body 2. The access cover unit 3 includes an access cover 3*a* and an opening/closing mechanism for the access cover 3*a*. A paper exit 4 of a specific width is formed at the front of the outside case 2*a* of the printer body 2. An exit guide 5 projects to the front from the bottom of the paper exit 4, and a cover opening/closing lever 6 is disposed beside the exit guide 5. A rectangular opening 7*a* for loading and removing roll paper in the roll paper compartment rendered inside the printer case 2 is formed in the outside case 2*a* below the exit guide 5 and cover opening/closing lever 6. This opening 7*a* is closed by the access cover 3*a*.

This part of the printer 1 is configured so that both fanfold paper 8 and roll paper 9 can be handled uniformly.

First, in order to use fanfold paper 8, the cover opening lever 6 is operated to release the lock of the access cover unit 3, and the exit guide 5 mounted on the access cover unit 3 is pulled forward. The access cover unit 3 is then pivoted forward on the bottom end thereof to a substantially horizontal position. Because the platen 10 that determines the printing position moves forward with the access cover 3*a*, an attachment 11 is attached to the back side of the platen 10 at this time.

The access cover 3*a* is then closed, and the fanfold paper 8 is manually inserted from the paper insertion opening 12 formed in the back side 2*b* of the printer case 2. Once the fanfold paper 8 is inserted a specific distance from the paper insertion opening 12 into the printer case 2, the fanfold paper 8 is automatically loaded and threaded through a fanfold paper transportation path (paper transportation path for first recording paper) B that travels from the paper insertion opening 12 passed the printing position A to the paper exit 4. See FIG. 3.

In order to use roll paper 9, the access cover unit 3 is opened to the horizontal position, and the attachment 11 is removed. When the access cover unit 3 is open and horizontal, the roll paper compartment 7 is open, and the and the roll paper transportation path C from the roll paper compartment 7 passed the printing position A to the paper exit 4 is open. After pulling off a paper leader 9*a*, the roll paper 9 is placed from the front of the printer into the roll paper compartment 7. When the access cover 3*a* is then closed, the paper leader 9*a* is threaded through the roll paper transportation path (paper transportation path for second recording paper) C. See FIG. 4.

Internal Configuration

Figure 3:
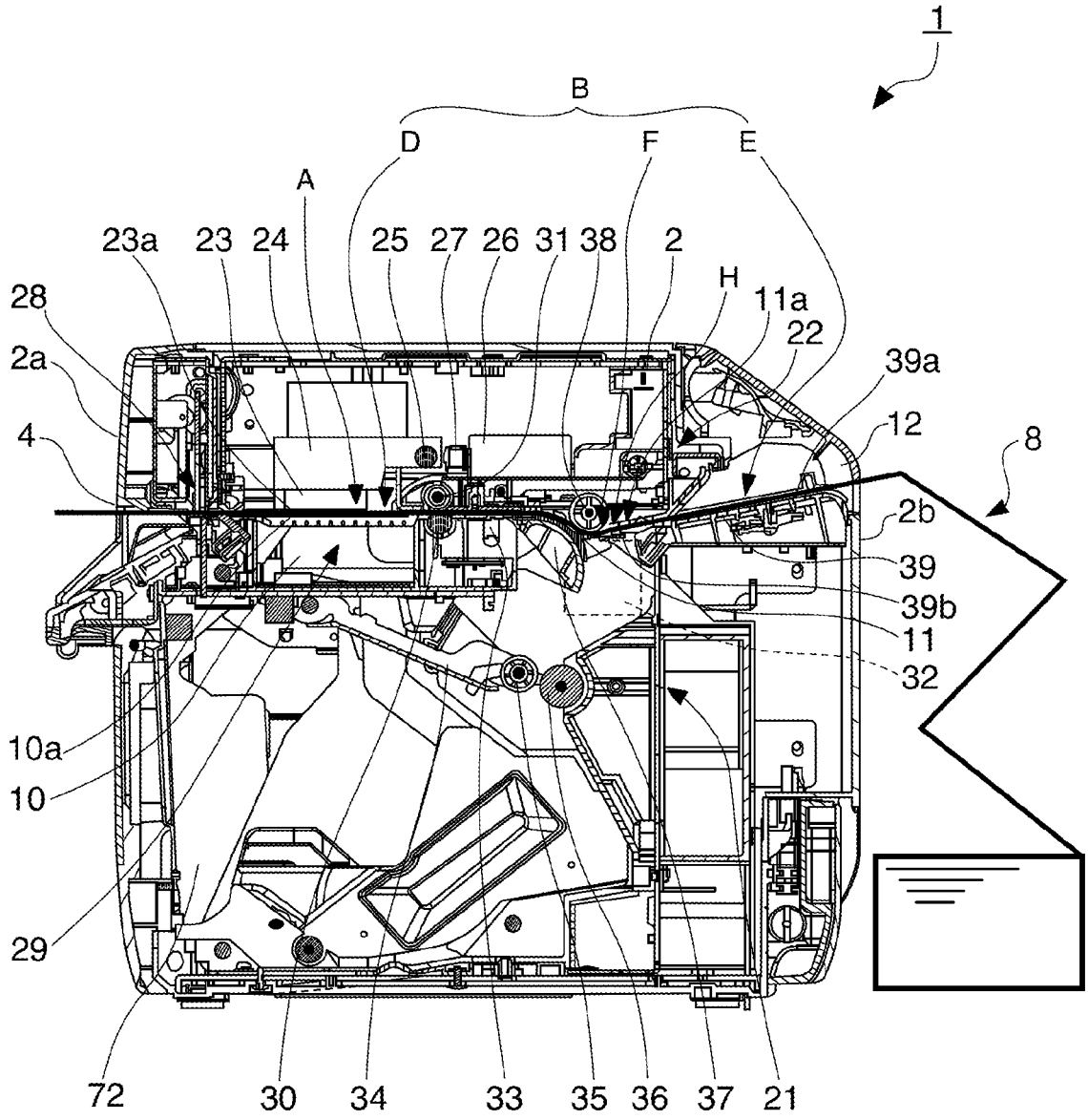
FIG. 3 shows the internal structure of the printer with an attachment affixed.

FIG. 3 shows the internal configuration of the printer 1 when the attachment 11 is installed.

A roll paper compartment 7 is formed in the center between the side walls of the printer frame 21 inside the printer 1. A head unit frame 22 is disposed horizontally at the top of the printer frame 21 above the roll paper compartment 7. Disposed to the head unit frame 22 are an inkjet print head 23, a carriage 24 that carries the inkjet print head 23, and a carriage transportation mechanism including a carriage guide shaft 25 that guides movement of the carriage 24 widthwise to the printer, and a carriage motor 26 and timing belt 27 for moving the carriage 24 bidirectionally along the carriage guide shaft 25. The inkjet print head 23 is mounted on the carriage 24 with the ink nozzle surface 23*a* facing down. An automatic paper cutter 28 having a movable knife protruding down is disposed at the front end of the head unit frame 22.

A platen 10 extending horizontally widthwise to the printer is disposed below the inkjet print head 23 with a specific gap therebetween. The platen 10 determines the printing position A of the inkjet print head 23, and is disposed on a rectangular platen frame 29 that extends widthwise to the printer. The platen frame 29 defines the horizontal paper transportation path (common transportation path) D that extends horizontally passed the printing position A. A plurality of suction holes are formed in a specific area of the surface 10*a* of the platen 10, and the fanfold paper 8 or the paper leader 9*a* of the roll paper 9 conveyed through the horizontal paper transportation path D over the surface 10*a* of the platen 10 is pulled thereto by drawing air through these suction holes by means of a vacuum mechanism not shown.

A paper feed roller 30 is disposed to the platen frame 29 horizontally widthwise to the printer behind the platen 10. A pressure roller 31 of a specific width is pressed with a specific pressure to the paper feed roller 30. The paper feed roller 30 is driven by a paper feed motor 32 that is mounted on the printer frame 21.

A paper detector 33 that detects whether or not the 9*a* or 8 has reached the horizontal paper transportation path D is disposed upstream from the paper feed roller 30. The paper detector 33 may be a reflective photosensor or a transmissive photosensor, for example.

An exit guide 5 is disposed to the front end of the platen 10. A gap of a specific width is open at a position between the printer frame 21 and head unit frame 22 at the front end of the platen frame 29, and this gap renders the paper exit 4.

A pressure lever 34 is disposed below the platen frame 29 extending diagonally downward to the back. The pressure lever 34 is urged down by the force of a spring, and a pressure roller 35 disposed to the distal end of the lever is pressed with specific pressure against a delivery roller 36.

A tension guide 37 that curves downward is attached to the back end of the platen frame 29. The tension guide 37 applies a specific tension to the paper leader 9*a* delivered from the roll paper compartment 7 through the horizontal paper transportation path D (see FIG. 4), and is urged upward by the force of a spring.

A paper pressure roller 38 is disposed behind the tension guide 37. A paper insertion opening 12 is formed in the back side 2*b* of the printer case 2 behind the paper pressure roller 38.

A frame member 39 is disposed between the paper pressure roller 38 and the paper insertion opening 12. The frame member 39 has a top surface 39*a* that slopes slightly downward from the paper insertion opening 12 toward the front of the printer, and a first transportation path E (that forms part of the fanfold paper transportation path B) for guiding the fanfold paper 8 inserted from the paper insertion opening 12 to the horizontal paper transportation path D is formed along this top surface 39*a*. A frame-member-side engaging part 39*b* that is approximately C-shaped in cross section is formed at a front end part of the frame member 39.

The attachment 11 is disposed between the horizontal paper transportation path D and first transportation path E. The front part of the attachment 11 is affixed to the tension guide 37, and the back end part is engaged with the frame-member-side engaging part 39*b*. When seen from the side of the printer, the top surface 11*a* of the attachment 11 has an S-shaped configuration that curves downward and then curves slightly upward. The paper pressure roller 38 is positioned above a recessed part in the top surface 39*a*. As a result, an intermediate paper transportation path F with a multi-curved cross section that passes between the top surface 11*a* of the attachment 11 and the paper pressure roller 38 is formed between the horizontal paper transportation path D and the first transportation path E. In some embodiments, the multi-curved cross section is an S-shaped cross section.

When the fanfold paper 8 is manually inserted from the paper insertion opening 12, the fanfold paper 8 advances along the first transportation path E inside the printer case 2, passes the intermediate paper transportation path F, and reaches the horizontal paper transportation path D. When the paper detector 33 detects that the fanfold paper 8 reached the horizontal paper transportation path D, the fanfold paper 8 is automatically loaded. More specifically, the paper feed roller 30 is driven by the paper feed motor 32, and the fanfold paper 8 is advanced along the horizontal paper transportation path D and positioned on the horizontal paper transportation path D. The fanfold paper 8 thus positioned on the horizontal paper transportation path D is then conveyed passed the printing position A while being pulled to the surface 10*a* of the platen 10, and is printed by the inkjet print head 23.

Using roll paper 9 as the printing medium is described next.

Figure 4:
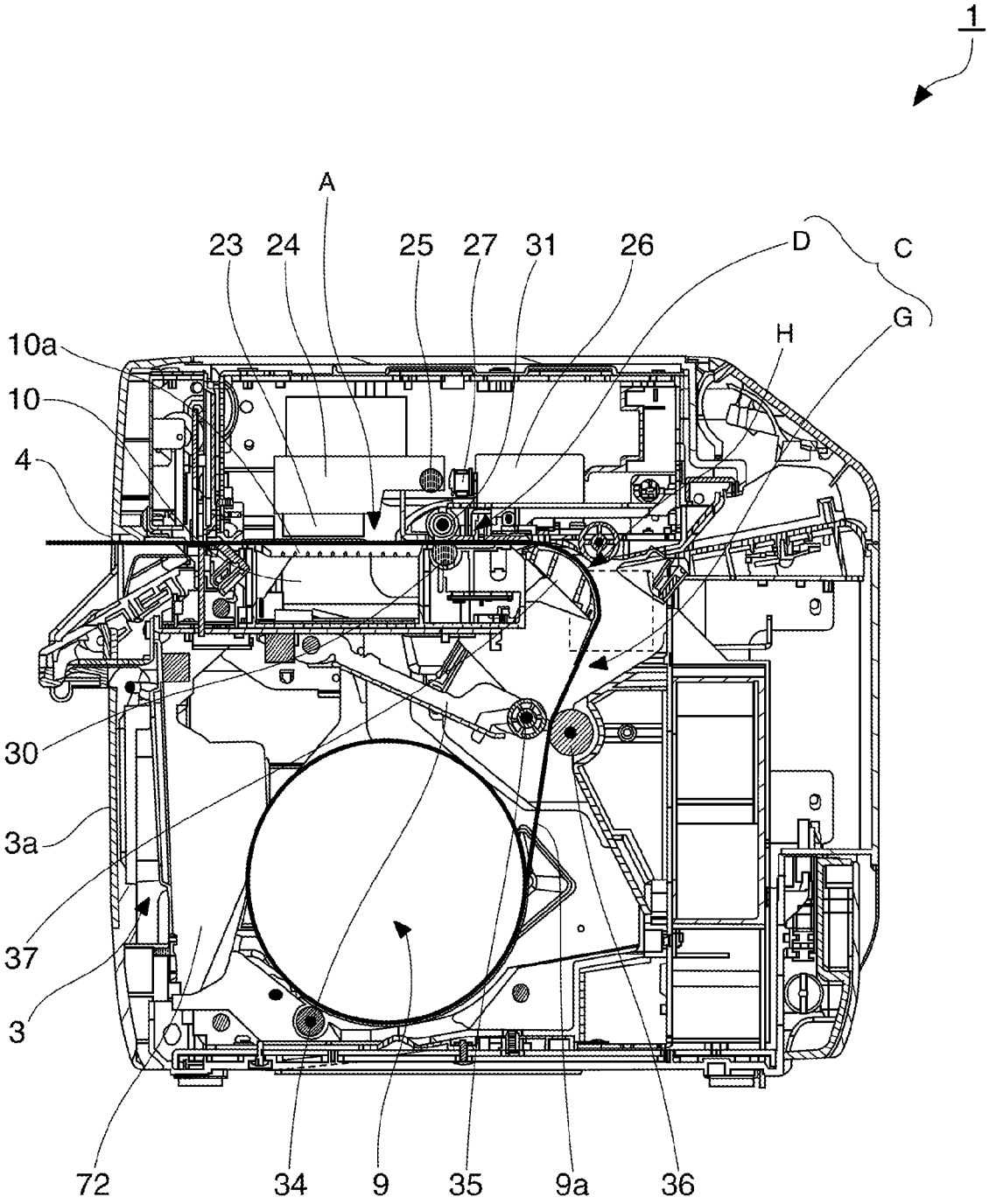
FIG. 4 shows the internal structure of the printer with the attachment removed.

When roll paper 9 is used, the printer 1 is used without the attachment 11. FIG. 4 shows the internal configuration of the printer 1 when the attachment 11 is not installed.

As shown in FIG. 4, the paper leader 9*a* delivered from the roll paper 9 is pulled up from the roll paper compartment 7 through a second transportation path G (that forms part of the roll paper transportation path C) between the nipping part of the delivery roller 36 and the pressure roller 35. The paper then curves around the tension guide 37 toward the front of the printer, and is guided to the horizontal paper transportation path D. The tension guide 37 guides the paper leader 9*a* from the second transportation path G to the horizontal paper transportation path D at the junction H where the first transportation path E from the paper insertion opening 12 to the horizontal paper transportation path D, and the second transportation path G from the roll paper compartment 7 to the horizontal paper transportation path D, merge.

When the roll paper 9 is loaded in the roll paper compartment 7, the access cover unit 3 is opened until it is horizontal. As a result, the platen 10, tension guide 37, paper feed roller 30, 34, and pressure roller 35 move toward the front of the printer in conjunction with the access cover 3*a*, and the roll paper transportation path C is open from the second transportation path G passed the tension guide 37 to the horizontal paper transportation path D. The roll paper 9 from which the paper leader 9*a* is pulled is inserted through this opening into the roll paper When the access cover 3*a* is then closed, the platen 10, tension guide 37, paper feed roller 30, 34, and pressure roller 35 returns to their original positions. As a result, the paper leader 9*a* pulled off the roll is loaded in the roll paper transportation path C from the second transportation path G passed the tension guide 37 to the horizontal paper transportation path D. The paper leader 9*a* loaded in the horizontal paper transportation path D is then conveyed passed the printing position A while being pulled to the surface 10*a* of the platen 10, and is printed by

Attachment

Figure 5A:
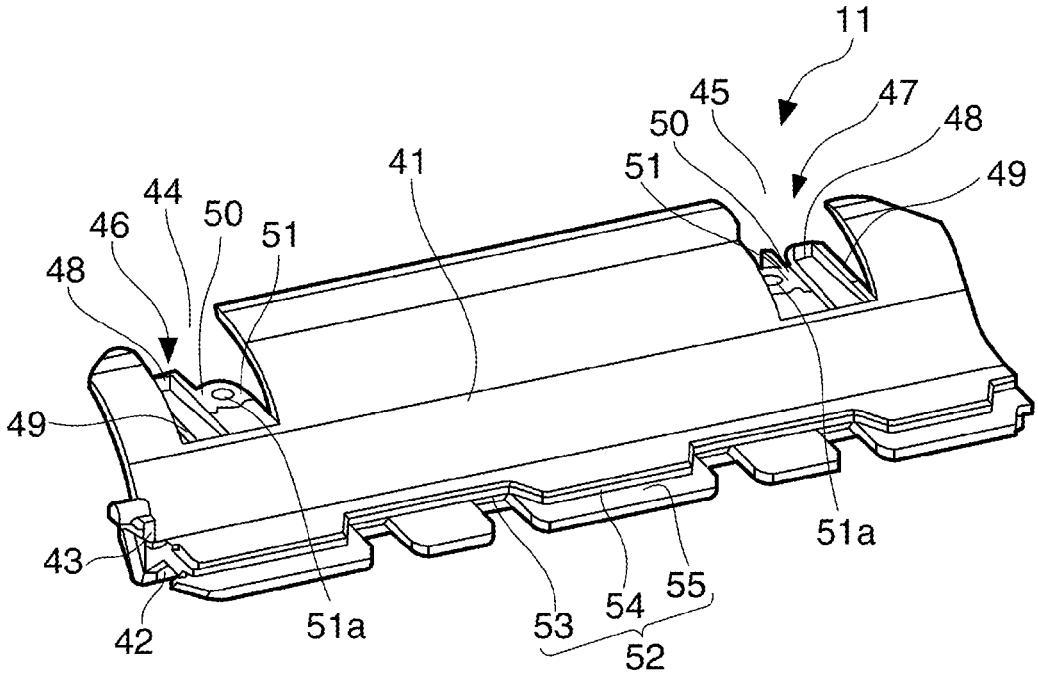
FIG. 5 is an oblique view of the attachment from the back of the printer and from the front of the printer.
Figure 5B:
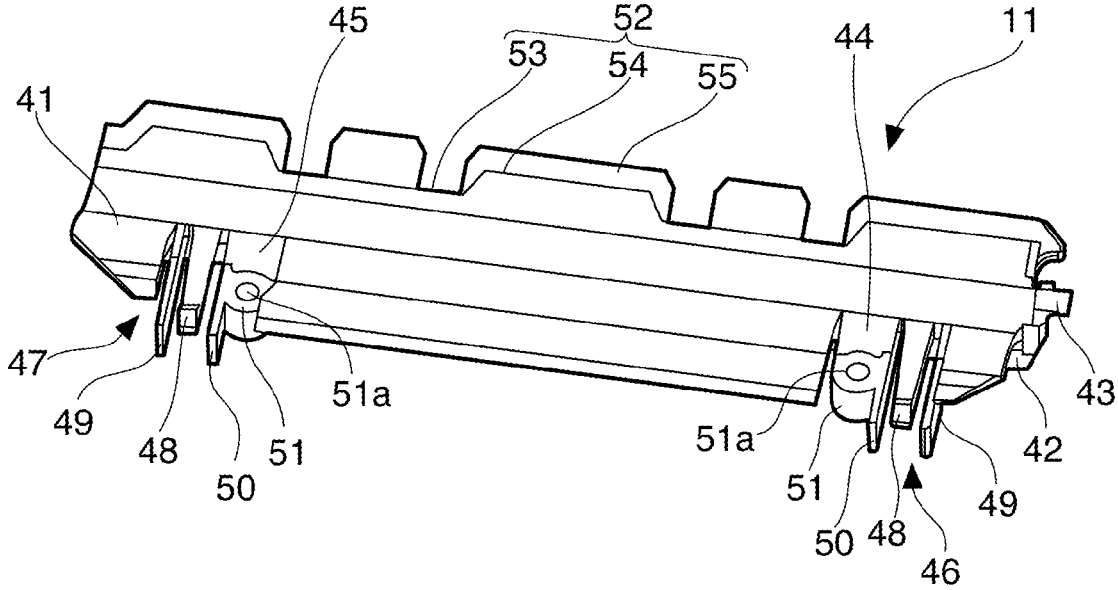
Figure 6A:
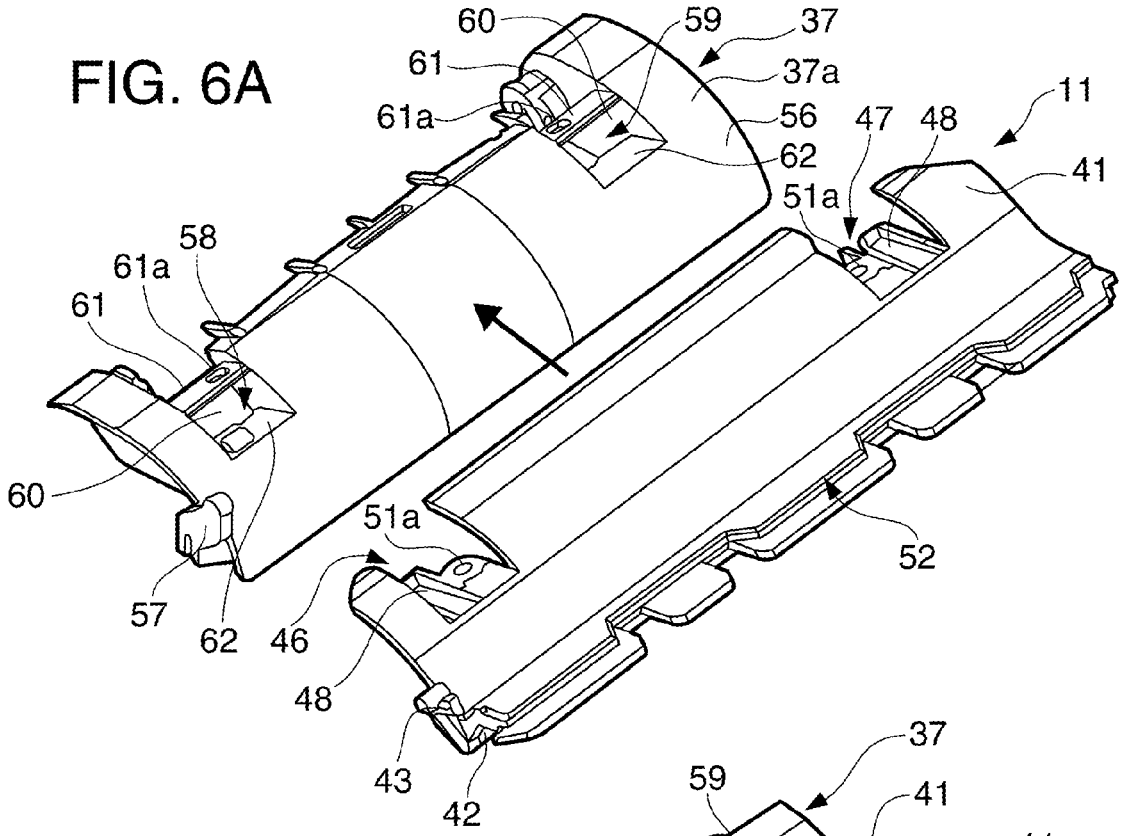
FIG. 6 is an oblique view and a section view of the tension guide and the attachment.
Figure 6B:
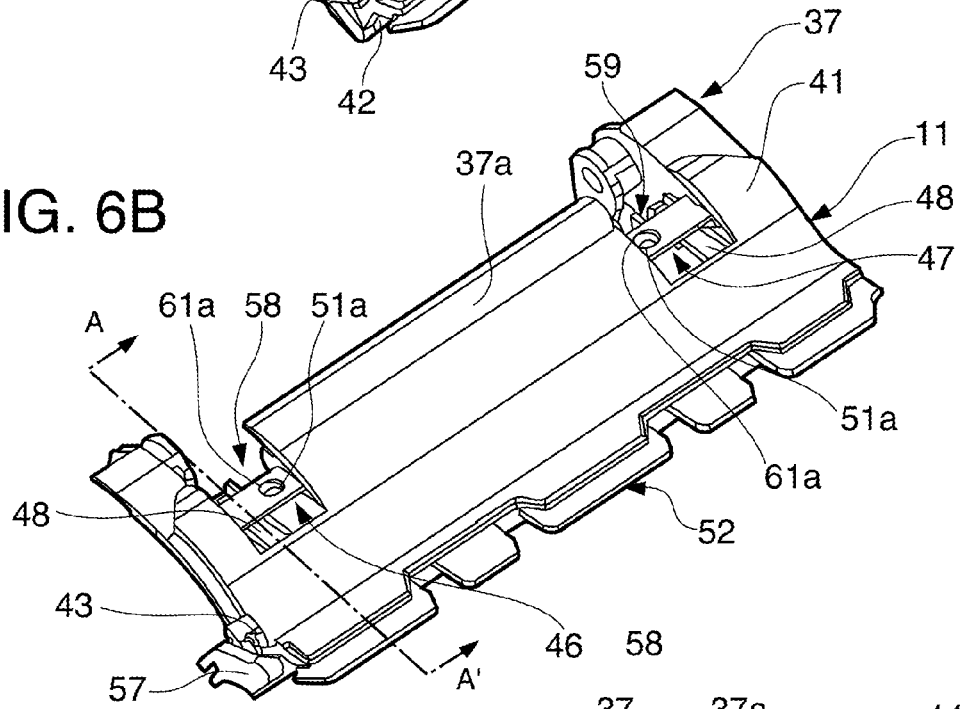
Figure 6C:
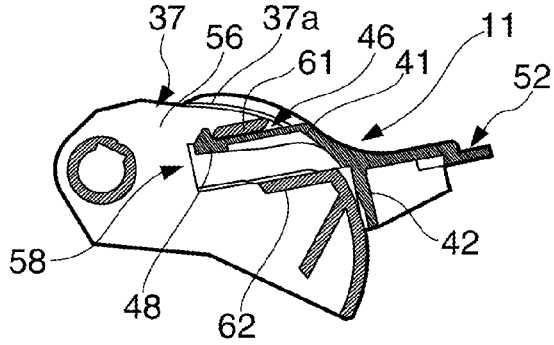

FIG. 5A is an oblique view of the attachment 11 from a position diagonally above the back of the printer. FIG. 5B is an oblique view of the attachment 11 from a position diagonally above the front of the printer. FIG. 6A is an oblique view from a position diagonally above the back of the printer showing the attachment 11 before it is attached to the tension guide 37. FIG. 6B is an oblique view from a position diagonally above the back of the printer showing the attachment 11 after it is attached to the tension guide 37. FIG. 6C is a vertical section view through line A-A' in FIG. 6B.

The attachment 11 has an S-shaped panel portion 41, a vertical panel portion 42, and an attachment-side tab 43. The S-shaped panel portion 41 is S-shaped when seen in section, and extends for a specific length widthwise to the printer. The vertical panel portion 42 has a constant height, and extends down from the back side of the recessed part of the S-shaped panel portion 41. The attachment-side tab 43 protrudes to one side widthwise to the printer from the concave part of the S-shaped panel portion 41.

Rectangular notches 44 and 45 are formed in the front convex part of the S-shaped panel portion 41 at both sides widthwise to the printer. Attachment-side installation parts 46 and 47 extending to the front of the printer are formed at the bottom edge parts of the notches 44 and 45. Each of the attachment-side installation parts 46 and 47 has a hook 48, two thin plates 49 and 50 extending parallel to each other with the hook 48 therebetween, and a tab 51 that projects to the inside widthwise to the printer from the thin plates 50 that are on the inside side widthwise to the printer. A through-hole 51*a* is formed vertically through each tab 51.

An attachment-side installation part 52 is formed on the back end of the S-shaped panel portion 41. This attachment-side installation part 52 has a plurality of notches 53 formed along the back edge of the S-shaped panel portion 41, a stepped part 54 formed stepping down from the back edge, and an insertion tab part 55 that extends to the rear from the stepped part 54. Note that the frame-member-side engaging part 39*b* has a projecting part corresponding to the notches 53, and is configured to receive the insertion tab part 55 in a part that is substantially C-shaped in section.

As shown in FIG. 6A, one tension guide 37 has a main guide 56 with a curved surface 37*a* curving down to the back, and a tension guide-side tab 57 that projects diagonally upward to the back of the printer from one end of the main guide 56 in the direction widthwise to the printer.

Tension guide-side installation parts 58 and 59 for installing the attachment 11 are formed at both ends of the main guide 56 in the direction widthwise to the printer. Each of the tension guide-side installation parts 58 and 59 has a rectangular notch 60, a flat top plate 61 that extends widthwise to the printer at the top side of each notch 60, and a bottom plate 62 that extends to the front of the printer from the bottom edge of each notch 60. A through-hole 61*a* is formed in each top plate 61 at a part on the inside side thereof widthwise to the printer.

The attachment 11 is attached from the back side of the tension guide 37 by inserting the attachment-side installation parts 46 and 47 between the top plate 61 and bottom plate 62 of the tension guide-side installation parts 58 and 59. When the attachment 11 is attached to the tension guide 37, the back side of the S-shaped panel portion 41 of the attachment 11 contacts the top side part of the curved surface 37*a* of the tension guide 37, and the bottom side of the vertical panel portion 42 contacts the bottom side of the curved surface 37*a* of the tension guide 37 as shown in FIG. 6B and FIG. 6C. The top plate 61 is also engaged by the hook 48.

When the attachment 11 is attached to the tension guide 37, the through-holes 51*a* in the tabs 51 of the attachment-side installation parts 46 and 47, and the through-holes 61*a* in the top plates 61 of the tension guide-side installation parts 58 and 59 are disposed coaxially. When the printer 1 is limited to applications that use fanfold paper 8, a pin, for example, is inserted through the through-holes 51*a* and through-holes 61*a* to fasten the attachment 11 to the tension guide 37.

Opening/Closing Mechanism of the Access Cover Unit

The mechanism for opening and closing the access cover unit 3 is described next with reference to FIG. 2, FIG. 3, FIG. 7, and FIG. 8.

Figure 7:
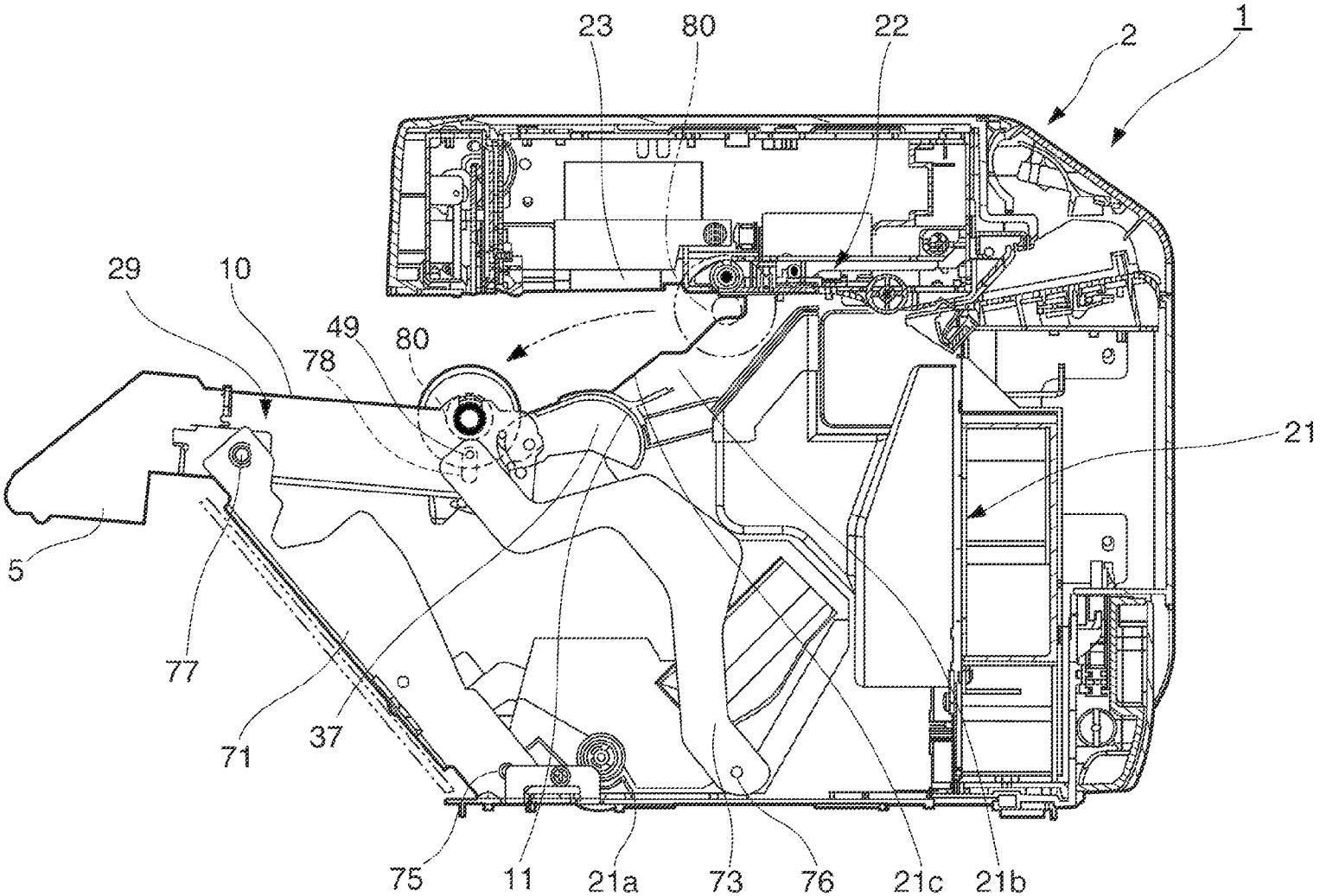
FIG. 7 is a schematic side view showing the access cover open slightly.
Figure 8:
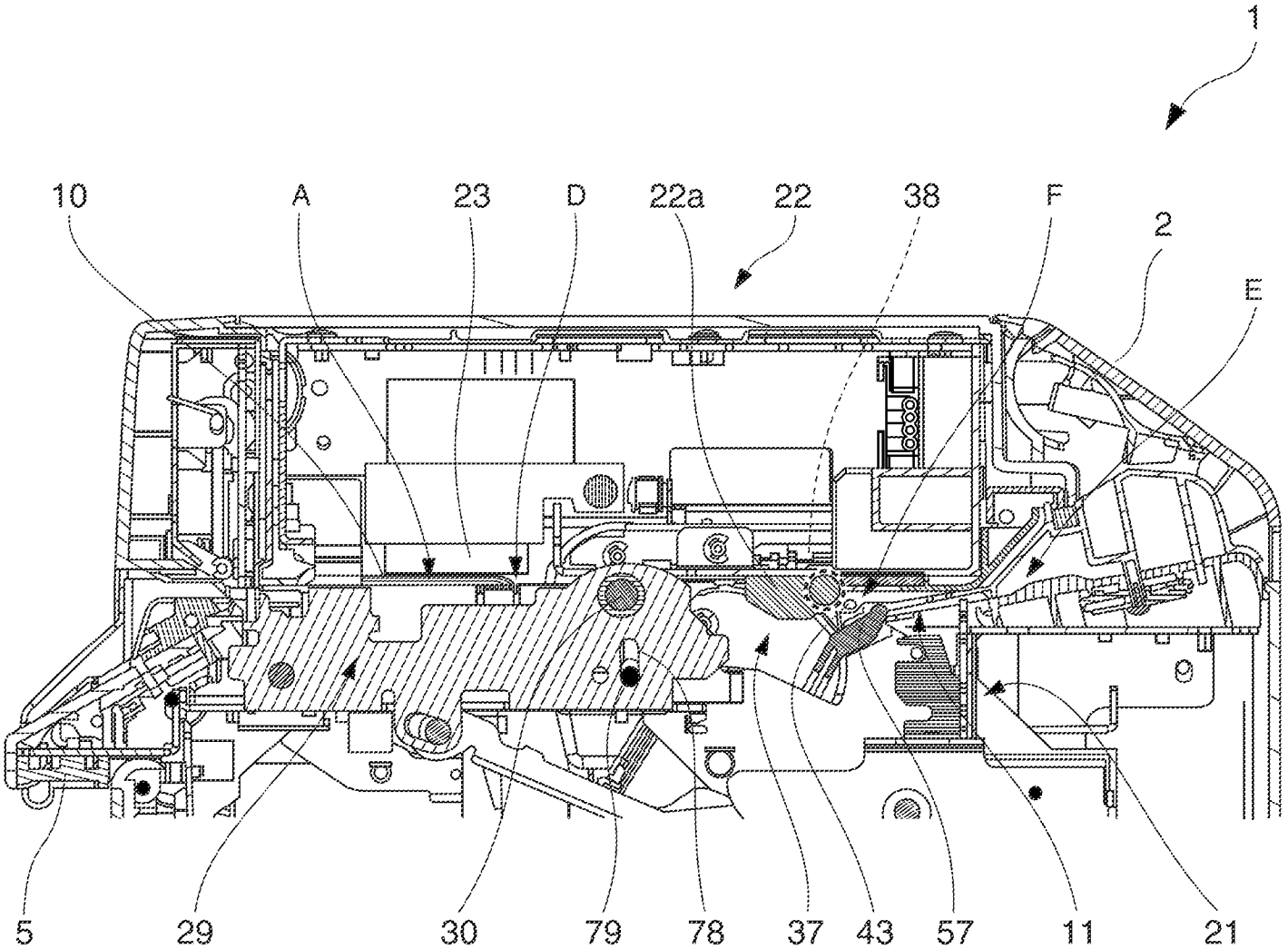
FIG. 8 is a schematic side view showing the curved stepped surface (shoulder surface) on the bottom end part of the head unit frame.

FIG. 7 is a schematic side view showing the access cover unit 3 open slightly, and shows the access cover unit 3 pulled forward. FIG. 8 is a schematic side view showing the curved stepped surface formed at a bottom end part of the head unit frame 22. Note that the access cover 3*a* of the access cover unit 3 is not shown in FIG. 7.

The access cover unit 3 is supported on the printer case 2 so that the cover unit can open and close by means of a four-node parallel linkage mechanism.

This parallel linkage mechanism includes a pair of left and right front parallel links 71 and 72 to which the access cover 3*a* is attached, and a pair of left and right rear parallel links 73 and 74. The access cover 3*a* is attached between the front parallel links 71 and 72.

The bottom end parts of the front parallel links 71 and 72 are supported by the bottom panel part 21*a* of the printer frame 21 to pivot freely forward and back on a horizontal shaft 75. The rear parallel links 73 and 74 are also supported by the bottom panel part 21*a* to pivot freely forward and back on a horizontal shaft 76.

The top end parts of the front parallel links 71 and 72 are connected freely pivotably on a horizontal shaft 77 at the front end parts of the platen frame 29. The top ends of the rear parallel links 73 and 74 and the back end of the platen frame 29 are coupled so that a specific amount of vertical motion is possible. An oval hole 78 is rendered in the platen frame 29 side with the long axis of the hole vertical, and the horizontal shaft 79 attached to the top end parts of the rear parallel links 73 and 74 is inserted in this hole 78 so that the horizontal shaft 79 can rotate freely and slide.

An inclined shoulder 21*c* for positioning is formed sloping upward from the front to the back on a side panel part 21*b* of the printer frame 21 on the left side of the roll paper compartment 7 so that a guide roller 80 for positioning can ride up to a position in the middle of the inclined shoulder 21*c*. The guide roller 80 projects horizontally to the side from the left side of the platen frame 29, and is attached freely rotatably to the platen frame 29. When the access cover unit 3 is closed, the guide roller 80 rides up the inclined shoulder 21*c*, thereby holding the platen frame 29 substantially horizontal and positioning the platen 10 attached here to the printing position A opposite the ink nozzle surface 23*a* of the inkjet print head 23.

As shown in FIG. 8, a curved stepped surface 22*a* (guide surface) is formed projecting down at the side of the paper pressure roller 38 below the head unit frame 22 on the right side of the roll paper compartment 7. The bottom edge of the curved stepped surface 22*a* allows the attachment-side tab 43 and the tension guide-side tab 57 to slide in contact together when the access cover unit 3 opens and closes. When the attachment-side tab 43 and the tension guide-side tab 57 slide over the curved stepped surface 22*a*, the tension guide 37 that is urged upward by the force of a spring is pushed down. As a result, the attachment 11 and tension guide 37 avoid colliding with the bottom of the head unit frame 22 and members protruding downward from the bottom of the head unit frame 22.

When the access cover unit 3 opens, the platen 10, tension guide 37, paper feed roller 30, and other members mounted on the platen frame 29 move together to the front of the printer. The attachment 11 affixed to the tension guide 37 is also released from the frame member 39, and moves together with the platen frame 29 to the front of the printer. When the access cover unit 3 tilts forward pivoting on the horizontal shaft 75 of the front parallel links 71 and 72, the platen frame 29 disposed between the front parallel links 71 and 72 and the rear parallel links 73 and 74 moves generally forward and down. This motion causes the guide roller 80 of the platen frame 29 to slide down along the inclined shoulder 21*c*. As a result, the second transportation path G, the intermediate paper transportation path F, and the horizontal paper transportation path D are opened. When the access cover unit 3 is opened further from the position shown in FIG. 6, the access cover unit 3 can be opened to the substantially horizontal open position in front of the printer as shown in FIG. 2. In this open position the front parallel links 71 and 72 and the rear parallel links 73 and 74 are folded together substantially horizontally beside the platen frame 29.

The operation of closing the access cover unit 3 from the open position is the reverse of the above operation. More specifically, just before the access cover unit 3 closes, the guide roller 80 of the platen frame 29 rides onto the inclined positioning shoulder 21*c* formed on the side panel part 21*b* of the printer frame 21, the guide roller 80 engages the inclined shoulder 21*c*, and the platen frame 29 is set to a substantially horizontal position. At this time the tension guide 37 and attachment 11 are guided by the curved stepped surface 22*a* so that they do not collide with the head unit frame 22, for example, and the insertion tab part 55 of the attachment-side installation part 52 is inserted to and engages the frame-member-side engaging part 39*b*.

As a result, the platen 10 is thus disposed to the printing position A opposite the inkjet print head 23 with a specific gap therebetween as shown in FIG. 3. The intermediate paper transportation path F connecting the first transportation path E and the horizontal paper transportation path D is thus formed. The second transportation path G is also formed below the tension guide 37.

Effect of Installing the Attachment

When the access cover 3*a* is closed with the attachment 11 attached to the tension guide 37 in this embodiment of the invention, an intermediate paper transportation path F connecting the horizontal paper transportation path D and the horizontal paper transportation path D is formed at junction H, at or near where the first transportation path E and the second transportation path G merge. Because an interruption in the fanfold paper transportation path B from the paper insertion opening 12 to the printing position A is thus eliminated, the fanfold paper 8 inserted from the paper insertion opening 12 can be set in the horizontal paper transportation path D without a paper jam occurring.

In addition, when the intermediate paper transportation path F connecting the horizontal paper transportation path D with the first transportation path E is formed at the junction H, the space between the second transportation path G and the horizontal paper transportation path D is closed. As a result, when using fanfold paper 8 is selected, the paper leader 9*a* pulled from the roll paper 9 can be prevented from being inserted to the horizontal paper transportation path D.

Furthermore, because the horizontal paper transportation path D and the intermediate paper transportation path F are formed in conjunction with the closing operation of the access cover 3*a*, the horizontal paper transportation path D and the first transportation path E can be connected by means of a simple operation. In addition, because the horizontal paper transportation path D and the intermediate paper transportation path F are opened in conjunction with the opening operation of the access cover 3*a*, recovering from a fanfold paper 8 jam is easy in the event that the fanfold paper 8 jams in the horizontal paper transportation path D or intermediate paper transportation path F.

Furthermore, when the access cover 3*a* closes in this embodiment of the invention, the attachment-side installation part 52 engages the frame-member-side engaging part 39*b*, rendering a positive connection between the attachment 11 and the frame member 39. As a result, the intermediate paper transportation path F and the first transportation path E are prevented from separating even if a load causing the intermediate paper transportation path F to open is produced when the fanfold paper 8 is inserted from the paper insertion opening 12, or a load causing the intermediate paper transportation path F to open is produced by fanfold paper 8 being back-fed from the printing position A to the paper insertion opening 12.

Yet further, because a curved stepped surface 22*a* that projects down is disposed beside the paper pressure roller 38 in this embodiment of the invention, collisions between the attachment 11 and the paper pressure roller 38 can be avoided when the intermediate paper transportation path F is formed. Furthermore, because the attachment 11 can be guided by the curved stepped surface 22*a*, the attachment 11 and the frame member 39 can be made to engage positively.

The fanfold paper transportation path B rendered by the horizontal paper transportation path D, the intermediate paper transportation path F, and the first transportation path E is configured so that the paper transportation path portion including the intermediate paper transportation path F on the upstream side of the paper feed roller 30 has an S-shaped configuration that curves in the paper transportation direction. As a result, when the fanfold paper 8 inserted from the paper insertion opening 12 to the printing position A passes this S-shaped portion of the transportation path, the shape of the folded portion is corrected so that the fanfold paper 8 is prevented or inhibited from lifting up and interfering with the print head as the fanfold paper 8 passes the printing position A.

In addition, because the attachment 11 is removably attached to the tension guide 37, which is used only when roll paper 9 is selected as the printing medium, a separate member specifically for installing the attachment 11 is not needed.

It should be noted that because the attachment 11 is removably attached to the access cover unit 3 of the access cover 3*a* that opens and closes the roll paper compartment 7, the part where the attachment 11 is attached can be accessed by opening the access cover 3*a*. Because installing and removing the attachment 11 is thus simple, this configuration is suitable for selectively using fanfold paper 8 and roll paper 9.

Yet further, in this embodiment of the invention the horizontal paper transportation path D and the second transportation path G are opened in conjunction with the operation opening the access cover 3*a*, and the horizontal paper transportation path D and the second transportation path G are formed in conjunction with the operation closing the access cover 3*a*. More specifically, when the access cover 3*a* is opened, the roll paper transportation path C from the second transportation path G to the horizontal paper transportation path D is opened. Therefore, when roll paper 9 is to be used, the roll paper 9 can be set to the printing position A by opening the access cover 3*a* and removing the attachment 11, inserting the roll paper 9 from which a paper leader 9*a* is pulled off into the roll paper compartment 7, and then simply closing the access cover 3*a*. User convenience is thus also good when using roll paper 9.

While the present invention has been described in connection with preferred embodiments thereof with reference to the accompanying drawings, various changes and modifications will be apparent to those skilled in the art in view of this disclosure. Any such change or modification is within the scope of the present invention to the extent it falls within any of the claims, as appended hereto or as later amended or added.

What is claimed is:

1. A printer, comprising:

a first paper transportation path configured to guide a fanfold paper, the first paper transportation path including an intermediate paper transportation path;

a second paper transportation path configured to guide a roll paper;

a common transportation path that passes a printing position and has a portion that is common with both a part of the first paper transportation path and a part of the second paper transportation path;

an attachment for forming the intermediate paper transportation path, the attachment connecting the first paper transportation path with the common transportation path; and an access cover for opening and closing a roll paper compartment;

wherein the attachment is attached to the access cover, and the intermediate paper transportation path opens in conjunction with the operation opening the access cover, and the intermediate paper transportation path is formed in conjunction with the operation closing the access cover; and wherein the intermediate paper transportation path is located upstream of where the first paper transportation path and the second paper transportation path merge, the intermediate paper transportation path having a multi-curved shape in the paper transportation direction for straightening the fanfold paper.

2. The printer described in claim 1, wherein:

the first paper transportation path includes a paper inlet for inserting the fanfold paper; and the second paper transportation path guides the roll paper pulled from a roll paper compartment.

3. The printer described in claim 1, wherein:

the second paper transportation path becomes open in conjunction with the operation opening the access cover, and the second paper transportation path is formed in conjunction with the operation closing the access cover.

4. The printer described in claim 1, wherein the intermediate paper transportation path has an S-curved shape in the paper transportation direction.

5. The printer described in claim 1, further comprising a print head, wherein the intermediate paper transportation path inhibits the fanfold paper from lifting up and interfering with operation of the print head as the fanfold paper passes the printing position.

6. A printer, comprising:

a first paper transportation path configured to guide a fanfold paper, the first paper transportation path including an intermediate paper transportation path;

a second paper transportation path configured to guide a roll paper;

a common transportation path that passes a printing position and has a portion that is common with both a part of the first paper transportation path and a part of the second paper transportation path; and an attachment for forming the intermediate paper transportation path, the attachment connecting the first paper transportation path with the common transportation path; wherein the intermediate paper transportation path is located upstream of where the first paper transportation path and the second paper transportation path merge, the intermediate paper transportation path having a multi-curved shape in the paper transportation direction for straightening the fanfold paper; and the second paper transportation path has a tension guide for adjusting the tension of the roll paper pulled from the roll paper compartment;

the tension guide is disposed on an access cover for opening and closing the roll paper compartment; and the attachment is removably attached to the tension guide.

7. A printer, comprising:

a first paper transportation path configured to guide a fanfold paper, the first paper transportation path including an intermediate paper transportation path;

a second paper transportation path configured to guide a roll paper;

a common transportation path that passes a printing position and has a portion that is common with both a part of the first paper transportation path and a part of the second paper transportation path;

an attachment for forming the intermediate paper transportation path, the attachment connecting the first paper transportation path with the common transportation path; and a paper pressure roller at a position opposing the attachment;

wherein the intermediate paper transportation path is located upstream of where the first paper transportation path and the second paper transportation path merge, the intermediate paper transportation path having a multi-curved shape in the paper transportation direction for straightening the fanfold paper; and wherein the multi-curved shape is formed by the surface of the attachment opposing the paper pressure roller and the outside surface of the paper pressure roller.

8. A printer, comprising:

a first paper transportation path configured to guide a fanfold paper, the first paper transportation path including an intermediate paper transportation path;

a second paper transportation path configured to guide a roll paper;

a common transportation path that passes a printing position and has a portion that is common with both a part of the first paper transportation path and a part of the second paper transportation path;

an attachment for forming the intermediate paper transportation path, the attachment connecting the first paper transportation path with the common transportation path; and a guide surface that guides the attachment to avoid contact with the paper pressure roller during operation of the printer;

wherein the intermediate paper transportation path is located upstream of where the first paper transportation path and the second paper transportation path merge, the intermediate paper transportation path having a multi-curved shape in the paper transportation direction for straightening the fanfold paper.

* * * * *